United States Patent [19]

Ferster

[11] Patent Number: 4,548,553

[45] Date of Patent: Oct. 22, 1985

[54] PERISTALTIC PUMP STRUCTURE

[76] Inventor: Reuben I. Ferster, 2101 Hennepin Ave., Minneapolis, Minn. 55405

[21] Appl. No.: 653,605

[22] Filed: Sep. 24, 1984

[51] Int. Cl.[4] ..... F04B 43/12; F04B 45/08

[52] U.S. Cl. ..... 417/477

[58] Field of Search ..... 417/477, 476, 475

[56] References Cited

U.S. PATENT DOCUMENTS

| | | | |
|---|---|---|---|
| 2,651,264 | 9/1953 | Bruckmann | 417/477 |
| 2,988,001 | 6/1961 | D'Arcey et al. | 417/476 |
| 3,463,092 | 8/1969 | Meyer | 417/477 |
| 3,787,148 | 1/1974 | Kopf | 417/477 |
| 4,043,712 | 8/1977 | Azzolini | 417/477 |
| 4,189,286 | 2/1980 | Murry et al. | 417/477 |
| 4,231,725 | 11/1980 | Hogan | 417/477 |
| 4,363,609 | 12/1982 | Cosentino et al. | 417/477 |
| 4,487,558 | 12/1984 | Troutner | 417/477 |

*Primary Examiner*—Richard E. Gluck

*Attorney, Agent, or Firm*—Leo Gregory

[57] ABSTRACT

This invention relates to a peristaltic pump structure in which the improvement consists of provision for substantial adjustment in the size of the passage receiving a tube member and in providing for an external control of the positioning of the rollers to determine the desired pressure of passing fluid through the tube member prior to or during the course of the operation of the pump structure.

5 Claims, 8 Drawing Figures

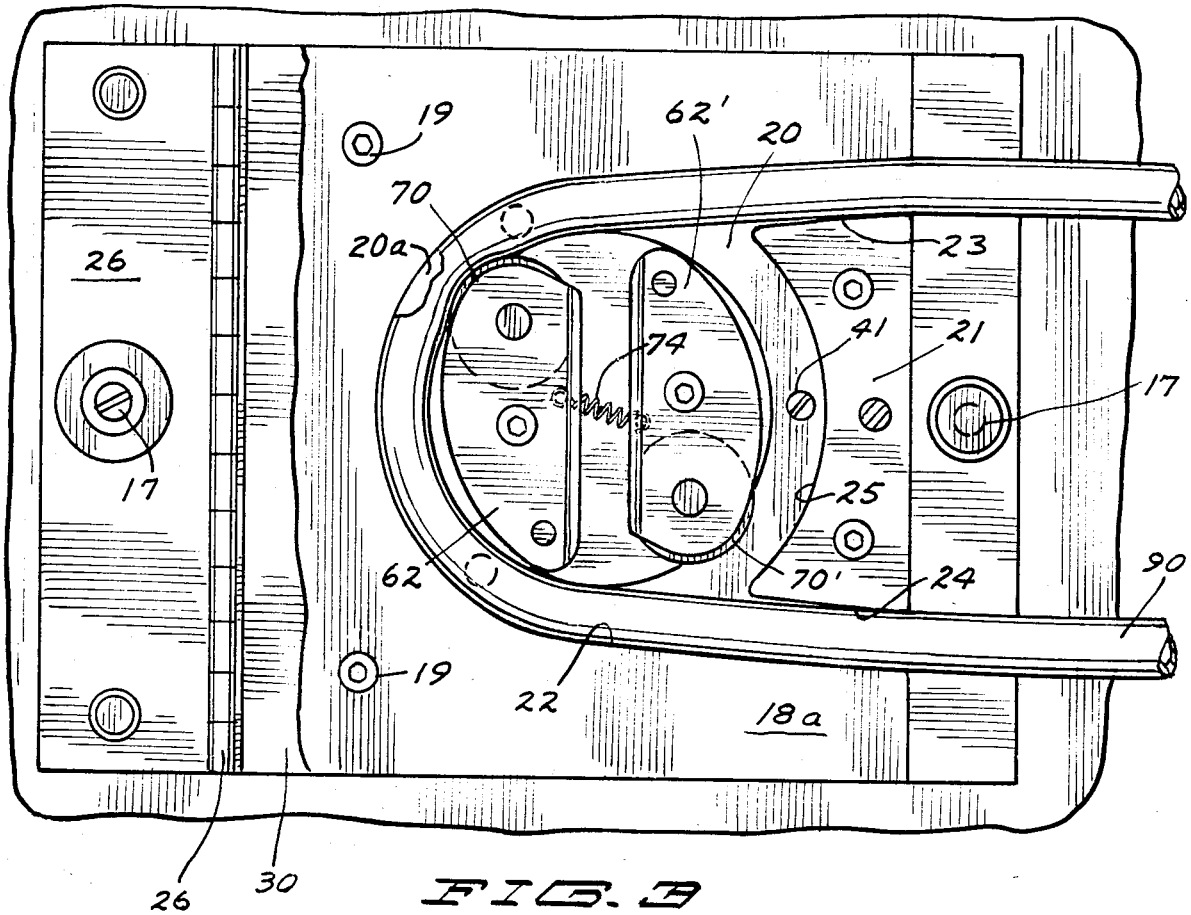
FIG. 3
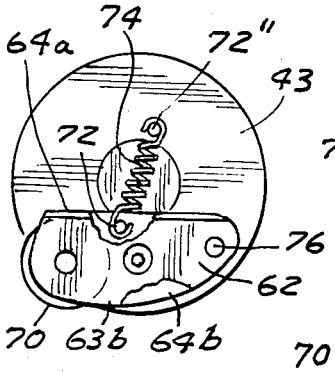
FIG. 6
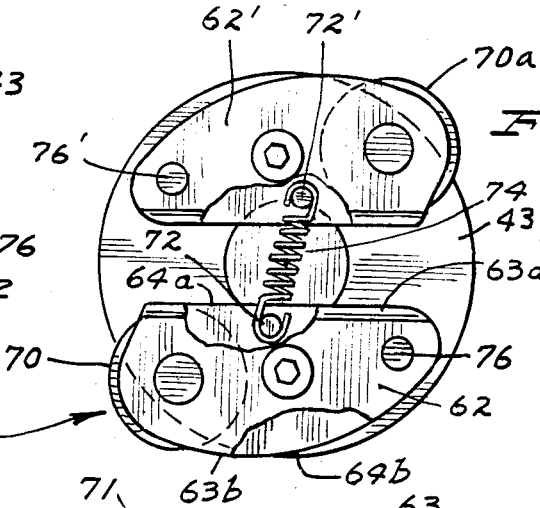
FIG. 5A
FIG. 5
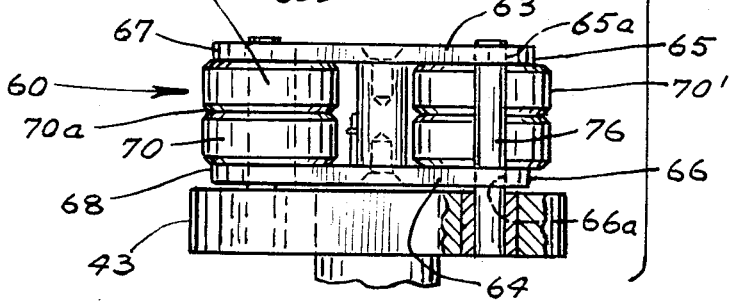
FIG. 5B

PERISTALTIC PUMP STRUCTURE

BACKGROUND OF THE INVENTION

1. Field of Invention

This invention relates to a peristalitc type of pump.

2. Description of the Prior Art

Prior art structures have been found to require preadjustment of the tube passage and are not known to make provision for adjustment of such passage externally of the structure or during the course of operation of the structure.

Further, prior art structures provide very little space for adjustment to permit any one structure to accommodate various tube sizes and some prior art structures require the structure to be preset to receive a specific tube size.

It is desirable to have a pump for the character above indicated which will accommodate a substantial range of sizes of tube diameters without requiring the apparatus to be preset for any given diameter and which provides for adjustment of the effective pressure generated in passing fluid through the tube during the course of operation.

SUMMARY OF THE INVENTION

This invention relates to significant improvement in a peristaltic pump structure in providing a tube passage initially of a size to accept various sized tubes and arranged and constructed that with the structure placed in operating position, the desired pressure can then be determined by an external control means in positioning the pressure rollers which bear against the tube member.

More particularly an object of this invention is to provide a base member having a channel therein to receive a tube member, a bearing plate concentric with the diameter of said channel having mounted thereon a pair of vertically spaced plate members pivotally connected oppositely diametrically of each other with respect to said bearing plate member and carrying therebetween diametrically opposed roller members, said pairs of plate members being yieldingly connected by a coil spring and having a cover plate overlying said channel and said plate member, an adjustment member carried by said cover plate having a cone at its inward end engaging said plate members to cause the same to be spaced apart by inward adjustment of said cone whereby said roller members in being positioned oppositely of their respective pivot pins swing outwardly to adjust the pressure applied to a tube member which pressure may be critically controlled by the minute adjustment of engagement of the cone member with said plate members.

These and other objects and advantages of the invention will be set forth in the following description made in connection with the accompanying drawings in which like reference characters refer to similar parts throughout the several views.

BRIEF DESCRIPTION OF THE DRAWINGS

FIG. 3 is a view similar to that of FIG. 1 taken on line 3—3 of FIG. 2 and having the cover portion thereof broken away;

FIG. 5 is a composite view of FIGS. 5*a* and 5*b* showing the pump assembly in top plan and side elevation with portions broken away; and FIG. 6 is a top plan view showing a modification.

DESCRIPTION OF A PREFERRED EMBODIMENT

Figure 1:
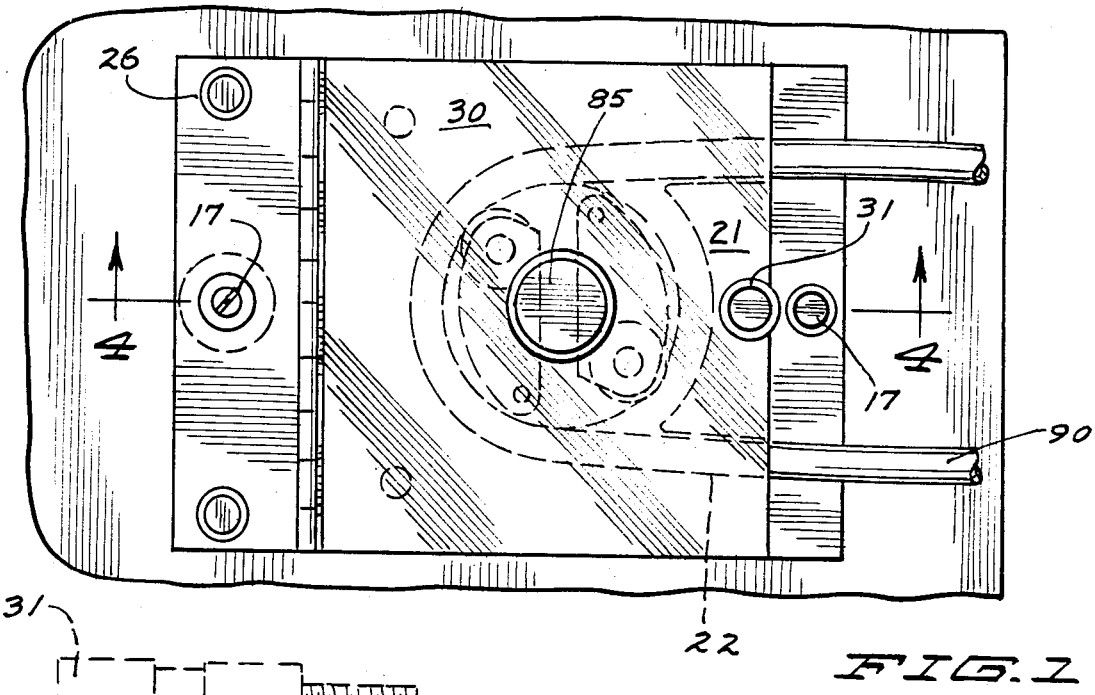
FIG. 1 is a top plan view with a portion thereof being shown in dotted line.

The peristaltic pump structure which is the subject of this application is of the class of pumps sometimes referred to as roller pumps which are particularly adapted to compress a flexible tube to move liquid therethrough at a fairly accurate prescribed pressure. The novelty present in the structure herein will be described in the following text.

Referring to the drawings, the pump structure herein is indicated generally by the reference numeral 10.

Figure 2:
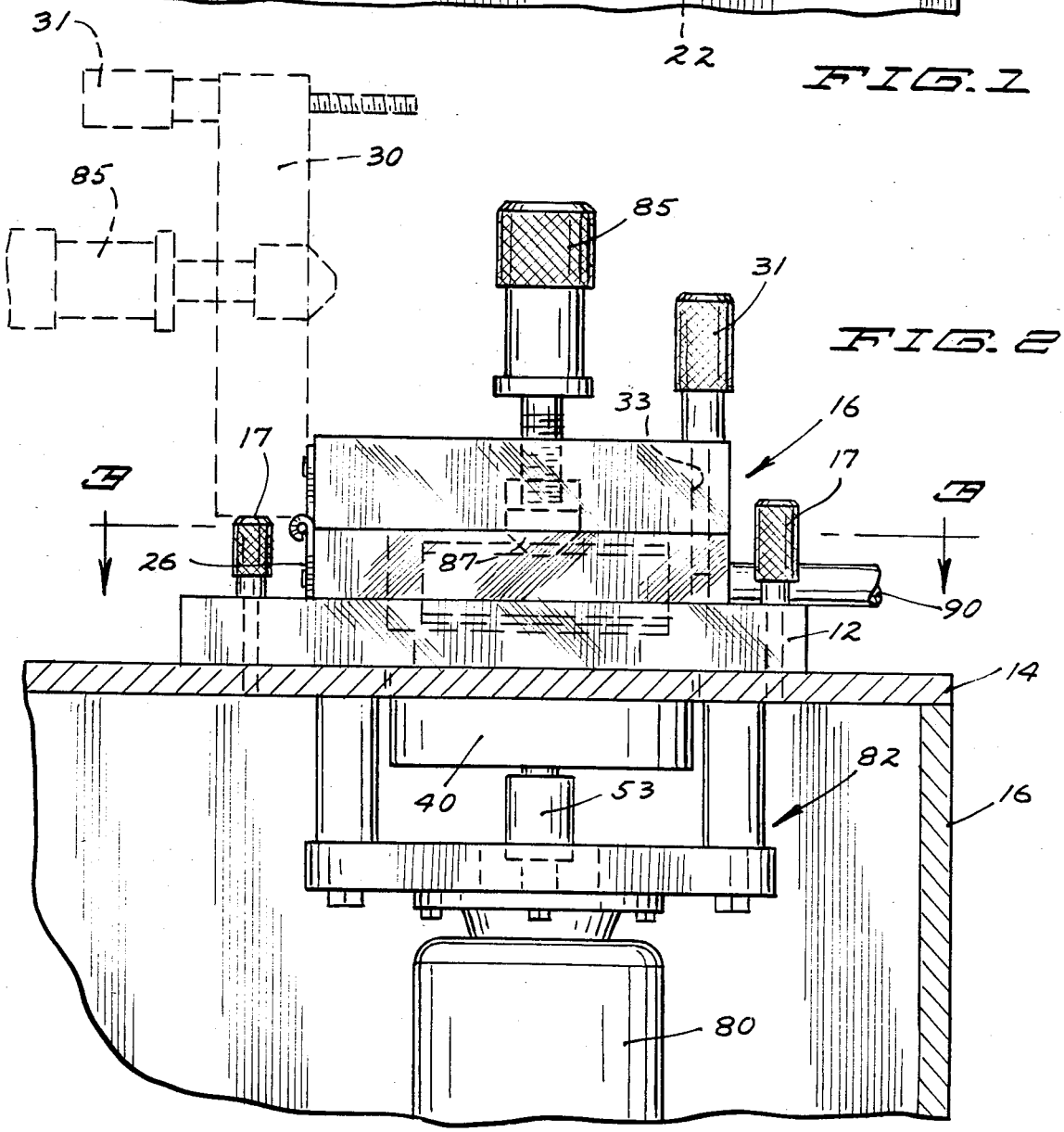
FIG. 2 is a view in side elevation partially in dotted line and a portion thereof being shown in an alternative position in dotted line.

As indicated in FIG. 2, said pump structure comprises a base plate member 12 here shown seated upon a table-like supporting structure having a top member 14 and depending supporting members thereabout as indicated by the support member 16.

Said base plate 12 is shown removably secured to said top supporting member 14 by knurled headed bolts 17.

Mounted upon said base plate member 12 is a pump housing plate member 18 secured to said base plate as by screws 19.

Said member 18 has its central and one end portion recessed forming a chamber 20 having an accurate wall or bearing surface 22. Secured across the open end 18*a* of said chamber is an insert member 21 spaced from the adjacent sides of said chamber as at 23 and 24 to form passages and the inner wall surface of said insert member is curved to form a vertical bearing surface as indicated at 25. Thus said chamber 20 defines a circular opening or recess having said end portion 18*a* defining the passages 23 and 24.

Secured to and overlying said plate member 18 by a plate hinge 26 is a cover plate or tube retaining member 30. Said cover plate has a knurled screw 31 extending therethrough at the free end thereof as indicated at 33, to be secured into the tapped hole 35 of the plate member 18.

Said base plate 12 has formed therein a recessed circular chamber 12*a* and having a circular flanged bottom wall 12*b*.

A cylindrical bearing block or housing 40 underlies said flanged wall 12*b* through an accommodating opening 14*a* in said supporting member 14 and is secured thereto by screws 41 through said flanged wall.

Figure 4:
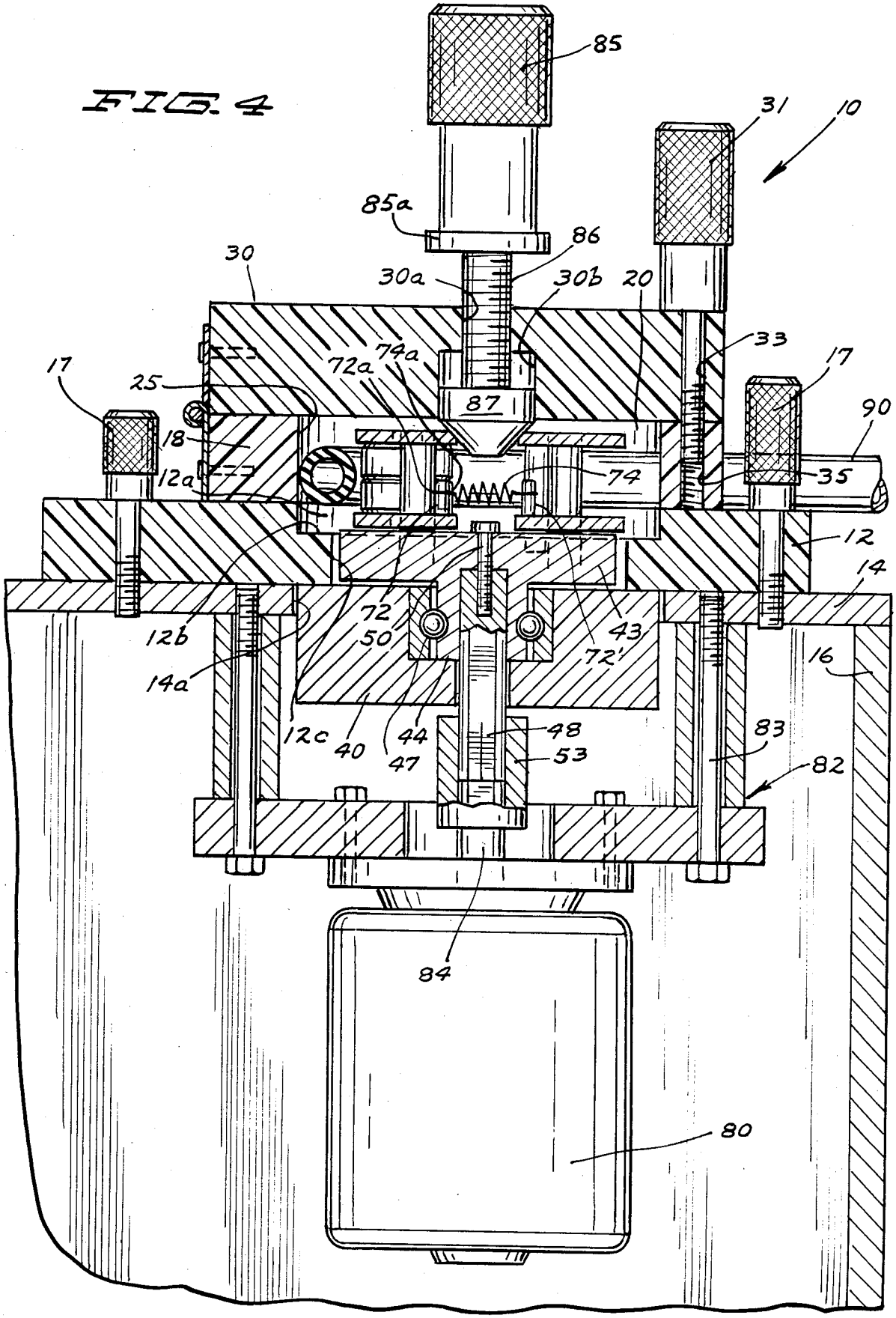
FIG. 4 is a view in vertical section taken on line 4—4 of FIG. 1 as indicated.

Said bearing block has a conventional interior construction as indicated in FIG. 4 comprising a rotatable face plate 43 disposed within said bottom wall 12*b* into the opening 12*c* thereof. Said face plate has a depending reduced portion 44 thereof extending into said bearing block being rotatably supported by bearings 47. Recessed into said depending portion is a drive shaft 48 secured by a screw 50 extending downwardly through said face plate 43. Said drive shaft carries a conventional drive coupling member 53.

Mounted upon said plate member 43 is a rotatable pump assembly 60 next to be described.

Said pump assembly consists of two identical elements 62 and 62' which are reversely positioned upon said face plate member in opposed operating positions. The element 62 will be described representative of both and the element 62' will have like numbered parts with a prime added.

Said element 62 as here shown comprises a pair of vertically spaced tapered plate members 63 and 64 having straight inside edges 63*a* and 64*a* and curved outside edges 63*b* and 64*b* and having reduced end portions 65 and 66 and larger end portions 67 and 68. Each of said end portions has a radius as indicated.

Said plate members 63 and 64 are secured in vertically spaced relation by a shoulder post 76 secured by flush screws at each end in a conventional manner. The tapered end of said plate members are apertured as shown at 65*a* and 66*a*.

Mounted between said end portions 67 and 68 is a roller 70 journaled onto a post or pin bearing 71 which has its ends press fit into said end portions 67 and 68. Said roller has a radius corresponding somewhat to the radius of said end portions 67 and 68 and is positioned to extend outwardly somewhat of said end portions 67 and 68. Said roller is shown having a central annular groove 70*a*.

A stub pin 72 is upstanding somewhat off center adjacent said straight wall 63*a*. Said pin has an annular groove 72*a* to retain one end portion 74*a* of a coil tension spring 74. The other end of said spring will be retained by a corresponding pin 72' of the element 62'.

Upstanding from said face plate 43 is a pin 76 which is disposed through the apertures 65*a* and 66*a* in having said element 62 positioned in operation position upon said plate member 43.

The plate member 43 may be driven in various ways. Illustrated here is a motor 80 suspended in a conventional manner from the support plate 14 by a bracket 82 which is secured by bolts 83. Said motor will be connected to a suitable power source. The drive shaft 84 of said motor is connected to the coupling member 53.

Referring to FIGS. 2 and 4, said cover member 30 has disposed therein substantially centrally thereof a fairly large knurled headed bolt 85 having a threaded shank 86 disposed through a tapped opening 30*a* in said cover member. Said tapped opening has a counter bore 30*b* at its inner side and journaled onto the end portion of said threaded shank extending through said cover member is a cone tip 87 which is freely rotatable.

Said bolt 85 is positioned to place said cone tip 87 centrally between said elements 62 and 62*a*, the same to be further described.

Disposed through said chamber 20 is a conventional flexible tube or tubular member 90.

It will be noted in FIG. 3 that the member 31 taken with the two elements 62 and 62' define a path or channel 20*a* to receive said tube 90.

OPERATION

With reference to the above description, the operation of the structure herein will be described.

The cover 30 is lifted and the flexible tube 90 is positioned down into the channel or path 20*a*. The elements 62 and 62' with their respective rollers 70 and 70' allow adequate clearance for easy and rapid positioning of said tube. There is sufficient clearance in the channel 20*a* to allow for substantial variation in the size of the tube positioned therein.

With the tube positioned, the cover 30 is lowered and secured by the locking screw 31.

With reference now to the elements 62 and 62', these are mirror images of one another positioned upon the plate member 43 in an end wise reverse relationship, each being swingably mounted upon its respective pin (76 and 76') and being yieldingly urged together by the coil spring 74.

With the cover 30 in closed position, the cone tip 87 engages said elements 62 and 62' centrally therebetween of the straight edges 63*a* and 63*a'* of the upper plate members 63 and 63'.

With the adjusting screw 85 in fully retracted position and with said cone 87 correspondingly being drawn into the counter bore 30*b*, there is no engagement of the element 62 and 62' by said cone.

At this point the tube positioned within the channel 20*a* is under no externally applied pressure.

The pressure adjusting screw 85 is rotated downwardly to cause said cone 87 to engage and separate the elements 62 and 62'. It is noted that as said cone pressure is applied, the rollers 70 and 70' are caused to swing outwardly of the plate member 43 away from each other to apply pressure against the adjacent wall portions of the tube 90.

The thread of said screw 85 is of a suitable pitch to permit a precise pressure adjustment of small increments of pressure. The measurement of the degree of pressure applied is not here shown. Various conventional means may be used. A meter may be adjacent the outlet end of the tube to measure the pressure of fluid passing through the tube. The shoulder 85*a* of the screw 85 may have a dial point thereon with reference to a calibrated scale on the surface of said cover about said screw. Other conventional means may be used.

In view of prior art devices, the ease of placing the tube 90 in operating position, the ease of pressure adjustment while the unit is closed or in actual operation provide significant advantages in the use of applicant's structure.

MODIFICATION

Referring to FIG. 6, a modification is shown in which like reference numbers refer to like parts as above described and the reference numeral 72'' refers to a pin to anchor the free end of the spring member 74.

The operation is as above described. However instead of a pair of rollers 70 and 70' engaging the flexible tube 90, the pressure upon said tube to drive liquid therethrough is provided by the roller 70.

It will of course be understood that various changes may be made in form, details, arrangement and proportions of the parts without departing from the scope of the invention herein which, generally stated, consists in an apparatus capable of carrying out the objects above set forth, in the parts and combinations of parts disclosed and defined in the appended claims.

What is claimed is

1. A peristaltic pump structure comprising a base member, a recess in said base member defining an arcuate path, a pump assembly disposed within said recess rotatable upon an axis concentric with the axis of said path, said pump assembly comprising a circular plate member, a pair of diametrically opposed pin members upstanding from said plate member, a pair of elongated plate members respectively having opposite ends pivoted to said pin members, a pair of rollers being respectively journaled onto said ends of said pair of plate members remote from said first mentioned ends of said pair of plate members, means yieldingly holding said pair of plate members against separation by pivotal movement at said ends pivoted to said pin members, a flexible tube disposed through said arcuate path engaged by said rollers, a cover overlying said base member, a screw member tapped through said cover aligned with axis of said pump assembly, a cone journaled onto the end portion of said screw member extending inwardly of said cover, said screw member moving said cone downwardly of said cover to engage said pair of plate members therebetween and separate the same causing said rollers to swing outwardly into pressure engagement with said tube and means driving said circular plate member to move said rollers into pressure engagement with said tube extending through said arcuate path.

2. A peristaltic pump structure comprising:

a base member, a recess in said base member defining an arcuate path, a pump assembly disposed into said recess comprising rotatable means in said recess concentric with the axis of said arcuate path, yieldingly pivotal means carried by said rotatable means, rotating means carried by said yielding means, a cover overlying said pump assembly, a threaded member tapped through said cover in alignment with the axis of said rotatable means, a cone member journaled onto the end portion of said threaded member extending through said cover, said threaded member moving said cone member to engage said yielding means causing said rotating means to extend into said arcuate path, means driving said rotatable means, a flexible tubular member extending through said arcuate path, and said rotating means applying pressure to said tubular member progressively deforming said tubular member.

3. The structure of claim 2, wherein said rotatable means comprises a plate member, said yielding means comprises an elongated plate member, a pin member upstanding from said first mentioned plate member, said second mentioned plate member being pivoted to said pin member at one end thereof, the remaining end of said second mentioned plate member having said rotating means journaled thereon and extending outwardly thereof, and a coil spring retaining said second mentioned plate member.

4. The structure of claim 2, wherein said rotatable means comprises a plate member, said yielding means compromise a pair of elongated plate members in opposed position, a pair of pin members upstanding from said plate member, said pair of plate members being respectively pivoted to said pin members at a pair of their ends remote from each other, said rotating means comprising rollers, the remaining ends of said pair of plate members each having a roller journaled thereon, and a coil spring connecting said pair of elongated plate members.

5. The structure of claim 2, wherein, said pivotal means comprises a pair of vertically spaced elongated plate members and the same having said rotating means journaled therebetween at one said end thereof and extending outwardly thereof.

* * * * *